US009425554B2

(12) United States Patent
Iwatani

(10) Patent No.: US 9,425,554 B2
(45) Date of Patent: Aug. 23, 2016

(54) CONNECTOR INCLUDING CONNECTOR POSITION ASSURANCE MECHANISM AND CONNECTOR MATING BODY

(71) Applicant: Tyco Electronics Japan G.K., Kanagawa-ken (JP)

(72) Inventor: Shingo Iwatani, Kanagawa-ken (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 56 days.

(21) Appl. No.: 14/540,705

(22) Filed: Nov. 13, 2014

(65) Prior Publication Data

US 2015/0171551 A1 Jun. 18, 2015

(30) Foreign Application Priority Data

Nov. 13, 2013 (JP) ..... 2013-234514

(51) Int. Cl.

| | |
|---|---|
| ***H01R 13/641*** | (2006.01) |
| ***H01R 13/627*** | (2006.01) |
| ***H01R 13/635*** | (2006.01) |
| ***H01R 13/629*** | (2006.01) |
| ***H01R 13/703*** | (2006.01) |

(52) U.S. Cl.

CPC ..... *H01R 13/641* (2013.01); *H01R 13/6275* (2013.01); *H01R 13/62944* (2013.01); *H01R 13/635* (2013.01); *H01R 13/7032* (2013.01)

(58) Field of Classification Search

CPC ..... H01R 13/641

See application file for complete search history.

(56) References Cited

U.S. PATENT DOCUMENTS

| | | | | |
|---|---|---|---|---|
| 5,823,814 | A * | 10/1998 | Alwine | H01R 13/641 439/352 |
| 6,705,886 | B1 * | 3/2004 | Brown | H01R 13/641 439/352 |
| 6,780,045 | B2 | 8/2004 | Shuey et al. | |
| 7,175,451 | B2 | 2/2007 | Shuey | |
| 7,338,317 | B1 * | 3/2008 | Nagy | H01R 13/745 439/555 |
| 2010/0130039 | A1 | 5/2010 | Chen et al. | |
| 2013/0078835 | A1 | 3/2013 | Gunreben et al. | |
| 2013/0095692 | A1 | 4/2013 | Cole | |
| 2014/0335720 | A1 * | 11/2014 | Like | H01R 13/645 439/374 |
| 2015/0171551 | A1 * | 6/2015 | Iwatani | H01R 13/6275 439/352 |

FOREIGN PATENT DOCUMENTS

| | | | |
|---|---|---|---|
| JP | 2002343506 | A | 11/2002 |
| JP | 2008130546 | A | 6/2008 |
| WO | 2013092174 | A1 | 6/2013 |

OTHER PUBLICATIONS

French Search Report, dated Mar. 18, 2016, 2 pages.

* cited by examiner

*Primary Examiner* — James Harvey

(74) *Attorney, Agent, or Firm* — Barley Snyder

(57) ABSTRACT

An electrical connector is disclosed having a connector position assurance mechanism and a clip. The clip has a body and a mating detection terminal. The body is received in the connector position assurance mechanism only when the electrical connector is completely mated with a complimentary mating connector. The mating detection terminal contacts a complementary mating detection terminal in the mating connector to form an electrical circuit only when the body is positioned in the electrical connector.

20 Claims, 15 Drawing Sheets

CONNECTOR INCLUDING CONNECTOR POSITION ASSURANCE MECHANISM AND CONNECTOR MATING BODY

CROSS-REFERENCE TO RELATED APPLICATION

This application claims priority under 35 U.S.C. §119(a)-(d) to Japanese Patent Application No. 2013-234514, dated Nov. 13, 2013.

FIELD OF THE INVENTION

The present invention is generally related to an electrical connector, and more specifically, to an electrical connector having a connector position assurance (CPA) mechanism.

BACKGROUND

CPA equipped electrical connectors have a CPA mechanism that can be operated only when the electrical connector is fully mated to a complimentary connector. If the electrical connector is not fully mated, the CPA mechanism is locked by a housing of the electrical connector, alerting a user that the mating is not complete.

A conventional CPA mechanism, such as those seen in Japanese Patent No.'s 2003-264039 and 2008-533684, includes a locking member that is locked by the housing of the connector, and an operating member that communicates with the locking portion. After the electrical connector is mated to the complimentary connector, the mating status of the connection can be determined by whether the CPA mechanism operates. If the CPA mechanism can be operated through pressing the operating member, then confirmation that the connector is mated can be established. If the CPA mechanism cannot be operated, then the user is alerted that the electrical connector is not fully mated to the complimentary connector While conventional CPA-equipped electrical connectors provide an effective mechanism for determining the mating status, the effectiveness is entirely dependent on the user actually operating the CPA mechanism. When the user forgets to operate the conventional CPA mechanism, there is no feedback mechanism to alert the user of the mistake.

Consequently, there is a need for CPA-equipped electrical connectors that provide a feedback mechanism even in the absence of the user operating the CPA mechanism.

SUMMARY

An electrical connector has a connector position assurance mechanism and a clip. The clip has a body and a mating detection terminal. The body is received in the connector position assurance mechanism only when the electrical connector is completely mated with a complimentary mating connector. The mating detection terminal contacts a complementary mating detection terminal in the mating connector to form an electrical circuit only when the body is positioned in the electrical connector.

BRIEF DESCRIPTION OF THE DRAWINGS

The invention will now be described by way of example, with reference to the accompanying Figures, of which:

FIG. 5 (*b*) is a side view of the cap connector illustrated in FIG. 4;

FIG. 7 (*b*) is a second diagram of a procedure for mating the plug connector with the cap connector;

FIG. 7 (*c*) is a third diagram of a procedure for mating the plug connector with the cap connector;

FIG. 8 (*b*) is an enlarged view of a principal part of FIG. 8 (*a*);

FIG. 8 (*c*) is a cross-sectional view taken along line c-c in FIG. 7 of a positional relationship between mating detection terminals;

FIG. 9 (*b*) is a cross sectional view similar to FIG. 8 (*b*);

FIG. 9 (*c*) is a cross sectional view similar to FIG. 8 (*c*);

FIG. 10 (*b*) is a cross sectional view similar to FIG. 8 (*b*);

FIG. 10 (*c*) is a cross sectional view similar to FIG. 8 (*c*);

FIG. 14 (*b*) is an enlarged view of a principal part of FIG. 14 (*a*);

DETAILED DESCRIPTION OF THE PREFERRED EMBODIMENTS

Figure 1:
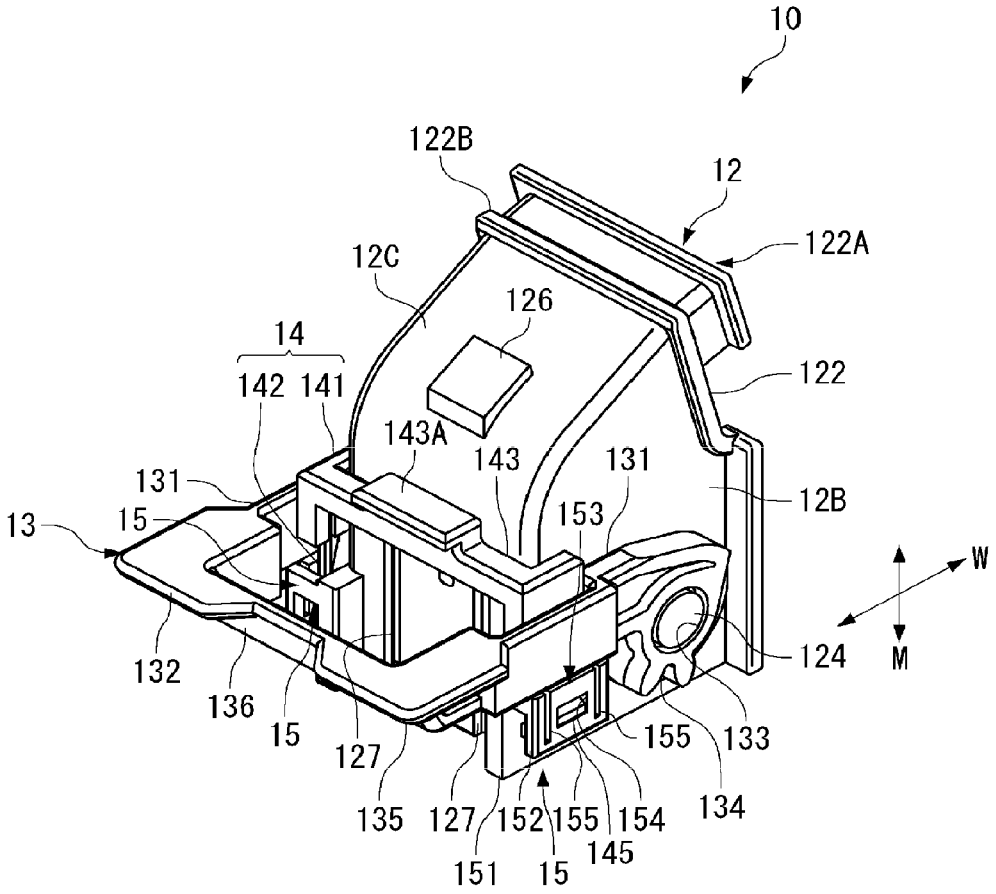
FIG. 1 is a perspective view of a plug connector.
Figure 2:
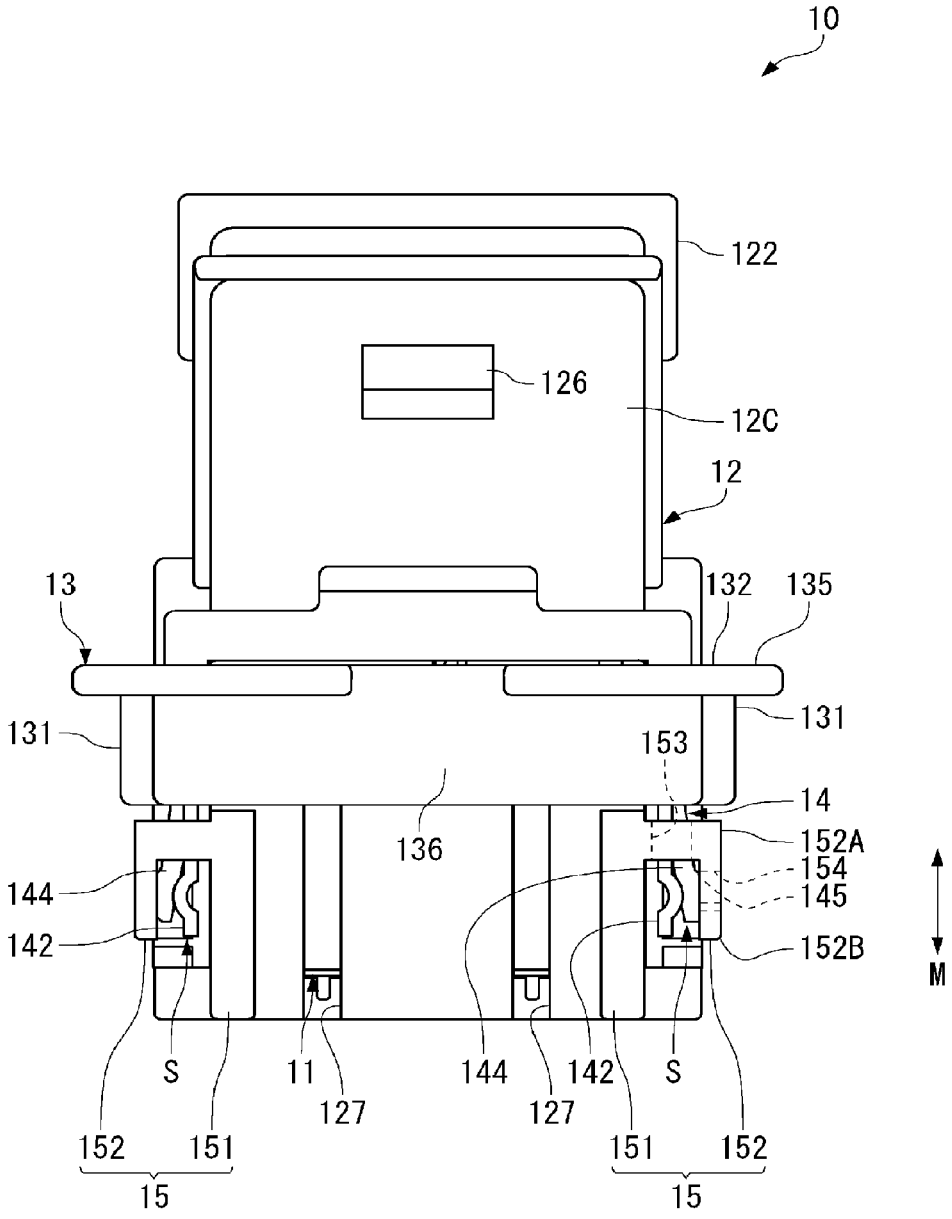
FIG. 2 is an elevation view of the plug connector in FIG. 1.

Embodiments of the present invention will be described below with reference to the accompanying drawings.

Referring to FIGS. 1-10, a plug connector 10 and a complimentary cap connector 20 will be described.

The plug connector 10 includes a contact housing 11 having a plurality of contacts 111, a connector body 12 positioned over the contact housing 11, a lever 13 disposed on the connector body 12, and a clip 14 mounted to the connector body 12.

The contact housing 11 includes a plurality of terminal receiving spaces 110 having an approximate rectangular shape and female contacts disposed 111 therein.

The contact housing 11, connector body 12, and lever 13 are injection-molded and made of resin.

The plurality of terminal receiving spaces 110 extend through the contact housing 11 along a mating direction M, from a mating end surface (not illustrated) to an opposite terminating end surface 11B of the contact housing 11. The plug connector 10 and a cap connector 20 are mated with each other along the mating direction M.

In an embodiment, the four rows of terminal receiving spaces 110 are positioned in the contact housing 11.

A conductive wire (not illustrated) is connected to the female contact 111 positioned in each of the terminal receiving spaces 110.

Figure 3:
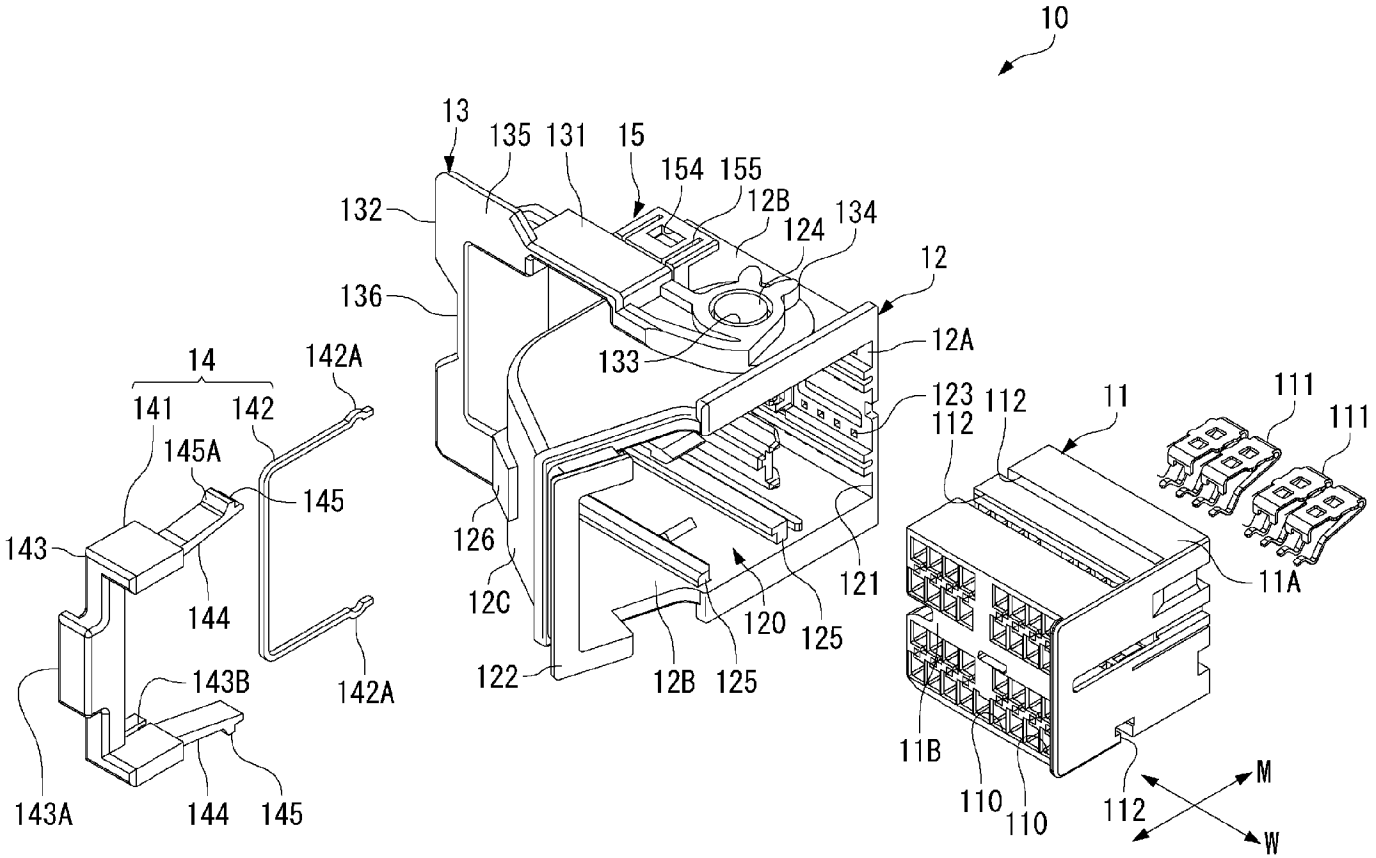
FIG. 3 is an exploded perspective view of the plug connector in FIG. 1.

The connector body 12 has a housing receiving space 120 into which the contact housing 11 is positioned. In the embodiment of FIG. 3, the contact housing 11 includes two opposite side surfaces, one of which is assigned reference numeral 11A, into which guide grooves 112 are disposed. The guide grooves 112 extend along a width direction W of the contact housing 11 and engage with complementary ridges 125 positioned along an inner surface of the housing receiving space 120 of the connector body 12 (discussed below). The width direction W is perpendicular to the mating direction M.

The connector body 12 includes an opening 121 positioned on a housing receiving end. When the contact housing 11 is positioned in the housing receiving space 120 through the opening 121, a bottom surface of the contact housing 11, which extends between and perpendicular to the two opposite side surfaces of the contact housing 11, is positioned in the opening 121.

A wire receiving shroud 122 is formed on a CPA member facing side of the connector body 12, which opposes the terminating end surface 11B of the inserted contact housing 11. The wire receiving shroud 122 has a lower wire receiving opening (not labeled), through which a plurality of electric wires (not shown) extend to connect with the female contacts 111 in the contact housing 11.

The connector body 12 includes a pair of sidewalls 12B, 12B positioned opposite to each other, a mating end wall 12A opposing the mating end surface of the inserted contact housing 11 and extending between and connecting the side walls 12B,12B, and a clip facing wall 12C opposite the mating end wall 12A and extending between and connecting the sidewalls 12B, 12B.

A plurality of male contact receiving holes 123 are formed in the mating end wall 12A, and extend as through-holes from an outer surface of the mating end wall 12A into the housing receiving space 120. Male contacts 22 in the cap connector 20 extend through the male contact receiving holes 123 when the cap connector 20 is mated to the plug connector 10. When the cap connector is mated to the plug connector 10, the male contacts 22 contact the female contacts 111 in the terminal arm receiving cavity 110 through the male contact receiving holes 123 to establish an electrical connection therebetween.

Each sidewall 12B, 12B has a shaft 124 disposed on an outer surface and protruding outward. The lever 13 is pivotably mounted to the shaft 124.

Ridges 125 are disposed on inner surfaces of the side walls 12B,12B in the housing receiving space 120, and engage with the complementary guide grooves 112 formed in the contact housing 11.

The clip facing wall 12C has a locking projection 126 positioned on an outer surface. The locking projection 126 engages with the lever 13, to lock the lever 13 in a mating position after the lever 13 finished performing a mating operation with the cap connector 20. Prior to the mating operation, when the lever 13 is in an opposite disengaged position, the locking projection 126 is spaced a distance apart from the lever 13.

A plurality of slits 127 (FIG. 1) are formed in the clip facing wall 12C and extend along the wall 12C in the mating direction M.

A pair of clip receiving members 15 are respectively formed on the connector body 12, on opposing sides of the clip facing wall 12C in the width direction. Taken together, the clip receiving members 15 and the lever 13 form a connector position assurance mechanism.

Each clip receiving member 15 includes a tabular base 151, which extends along the sidewall 12B towards the mating end wall 12A, a cantilevered beam 152 supported on the base 151, and a locking arm receiving space S.

The locking arm receiving space S is positioned between the base 151 and the cantilevered beam 152. A corresponding locking arm 144 of the clip 14 is positioned along the mating direction M into the locking arm receiving space S, and, when inserted, locks the locking arm 144 to the body 12.

The clip receiving member 15 is positioned below the lever 13 when the lever 13 is at a starting position of the mating operation. The starting position is understood to be the position of the lever 13 prior to the mating of the plug connector 10 to the cap connector 20 being complete.

The base 151 projects outward from the sidewall 129 in the width direction W. The base 151 is also used as a stopper that restricts the rotation of the lever 13.

A stopper 122B, which restricts the rotation of the lever 13, is also formed near an upper opening 122A of the wire receiving shroud 122, distal to the lower wire receiving opening (not labeled). The base 151 and the stopper 122B restrict an angle of rotation of the lever 13.

The cantilevered beam 152 is approximately rectangular, and has a supported end 152A connected to the base 151 and serving as a fulcrum, and a cantilevered free end 152B positioned opposite the supported end 152A.

A locking arm receiving opening 153 is positioned at the supported end 152A of the cantilever beam 152, and extends through supported end 152A into the locking arm receiving space S. The locking arm 144 of the clip 14 is positioned through the locking arm receiving opening 153 into the locking arm receiving space S.

Figure 8:
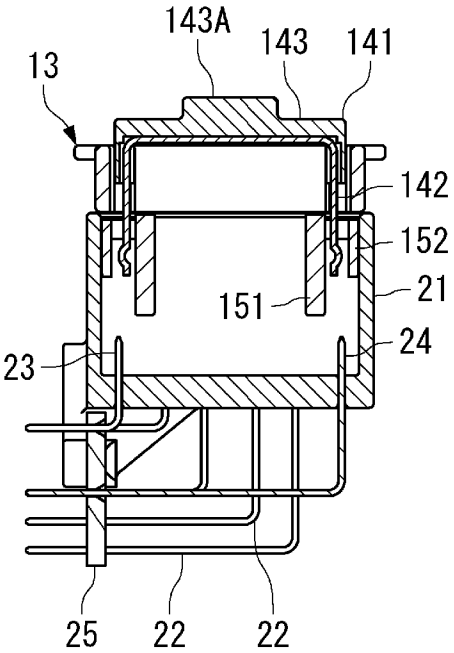
FIG. 8 (*a*) is a cross-sectional view taken along line a-a in FIG. 7, illustrating an operation of a connector position assurance mechanism.
Figure 8:
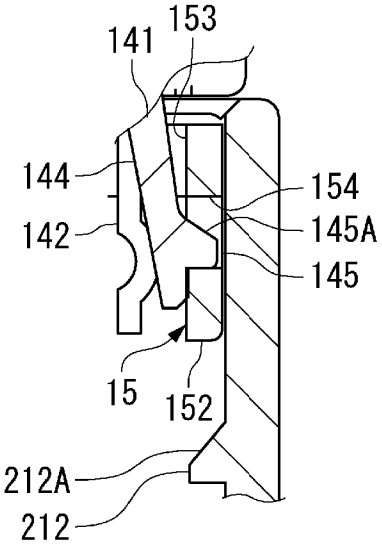
Figure 8:
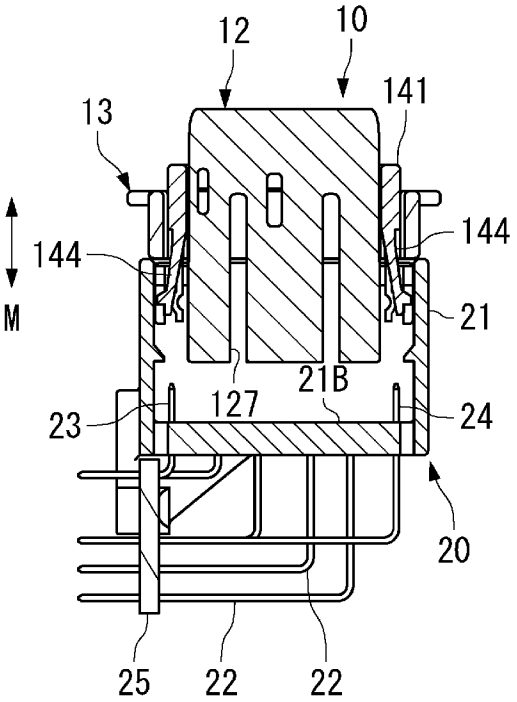

A projection receiving hole 154 is formed at an approximate midpoint in a length direction of the cantilevered beam 152 and extend therethrough in the thickness direction (see FIG. 8 (*b*)) from an outer surface to the locking arm receiving space S.

The locking arm 144 further includes a projection 145 disposed on an insertion end. When the locking arm 144 is positioned in the locking arm receiving space S, the projection 145 is positioned into the projection receiving hole 154, so that a body 141 of the clip 14 is locked to the clip receiving member 15.

A pair of slits 155 are formed on opposite sides of the projection receiving hole 154 in the cantilever beam 152, and extend along the mating direction M from the locking arm receiving opening 153. The slits 155 permit the cantilever beam 152 to be elastically deformed in an out-of-plane direction so that a stress to be exerted on the cantilever beam 152 is loaded.

In an embodiment of FIGS. 1 and 3, the clip 14 includes the body 141 and a mating detection terminal 142 retained in the body 141.

The clip 14 is positioned adjacent to the sidewalls 12B, 12B of the connector body 12, and is mounted to the clip receiving member 15 such that an outer surface of the locking arms 144 face an inner surface of the lever 13.

The body 141 has a bridging portion 143 to be operated to actuate the clip 14, and a pair of arms 144 positioned on opposite ends of the bridging portion 143. The body 141 is an injection molded product made of resin.

The bridging portion 143 is bent forward at both ends to form an approximate U shape. The pair of locking arms 144 is each connected to the opposite ends of the bridging portion 143 and extends approximately parallel in the same direction.

A grasping knob 143A, on which a user hooks a finger, is formed at an approximate midpoint of the bridging portion 143. When the grasping knob 143A is pressed, both locking arms 144 on the opposite ends of the bridging portion 143 enter the locking arm receiving space S in the clip receiving member 15.

A terminal receiving groove 143B is formed on an inner surface of each of the opposite ends of the bridging portion 143, and serves to receive and retain the mating detection terminal 142.

The locking arm 144 is generally rectangular, and has a thickness less than that of the bridging portion 143. The entire body 141, including the pair of locking arms 144, is approximately U-shaped, and upon insertion into the clip receiving member 15, the U-shaped locking arm 144 straddles the wire receiving shroud 122.

The pair of locking arms 144 extends away from the opposite ends of the body 141 at opposite angles, so that the distance between the locking arms is greater between their leading ends than the distance between their base ends.

As discussed above, the locking aim 144 has the projection 145 formed on the outer surface of the leading edge, and the projection 145 is inserted into the projection receiving hole 154 in the clip receiving member 15.

The projection 145 has an inclined plane 145A formed therein to act as a ramp, allowing the projection 145 to be smoothly inserted into the projection receiving hole 154.

The body 141 is restricted from being connected to the clip receiving member 15 until the plug connector 10 and the cap connector 20 are fully mated together. When the plug connector 10 and the cap connector 20 are mated together, the body 141, and more specifically, the locking arms 144 of the body 141, can be pressed into the clip receiving member 15. When the locking arms 144 are permitted to be inserted into the clip receiving member 15, the connectors 10, 20 are completely mated together. If the connectors 10, 20 are not completely mated together, such as being separated from each other, incompletely or halfway mated with each other, the body 141 and the locking arms 144 cannot be pressed in.

More specifically, if the body 141 can be pressed in and operated, the user is alerted that the connectors 10, 20 are completely mated together.

The mating detection terminal 142 has an approximate U-shape, and is made of an electrically conductive material, such as a metal or carbon. The mating detection terminal 142 may be formed by bending a conductive wire, or by stamping a metal plate.

When the body 141 is mated with the clip receiving member 15, the mating detection terminal 142 contacts complementary mating detection terminals 23, 24 position in the cap connector 20 to form an electrical connection therebetween. Contacts 142A are formed at both ends of the mating detection terminal 142. The contacts 142A are respectively pressed onto the mating detection terminals 23, 24.

The mating detection terminal 142 is integrally assembled to the body 141, being positioned in the terminal receiving groove 143B. When the mating detection terminal 142 is assembled to the body 141, the contact 142A projects outward from the leading end of the locking arm 144.

The operation of the mating detection terminal 142 is simultaneous with the operation of the body 141, since the mating detection terminal 142 is retained in the body 141.

The lever 13 assists the mating of the plug connector 10 with the cap connector 20 through a rotational action, and assists in the disconnection of the plug connector 10 from the cap connector 20 through a reversed rotational action.

The lever 13 integrally includes a pair of lever arms 131 and a lever bridging portion 132 connecting the lever 131, as illustrated in FIGS. 1 and 3, which taken together form an approximate U-shape.

The leading end of each lever arm 131 includes a shaft receiving space 133 positioned at a rotation center of the lever 13 and an integrally connected plug connector gear 134 that is coaxial with the rotation center.

A central portion of each lever arm 131 includes a clip receiving groove (not labeled), wherein a body 141 of the clip 14 is positioned in the clip receiving groove when the locking arms 144 of the clip 14 are engaged with the clip receiving members 15.

Each shaft 124, positioned on both sidewalls 12B,12B on the connector body 12, is inserted into the shaft receiving space 133 to pivotably mount the lever 13 to the connector body 12, with the lever 13 straddling the wire receiving shroud 122.

The teeth (not labeled) of the plug connector gear 134 only have a predetermined angular range required to mate the connectors 10,20. When the lever 13 is rotated, the plug connector gears 134 are also rotated, since the plug connector gears 134 integrally extend from each lever arm 131.

A complementary cap connector gear 213 is positioned on a cap connector housing 21 of the cap connector 20, and meshes with the plug connector gear 213 during the mating of the connectors 10,20.

A pair of lever gripping portions 135 are positioned on the lever 13, with each lever gripping portion 135 having an approximate L-shape extending on a portion of the lever arm 131 to a portion of the lever bridging portion 132. The lever gripping portions 135 assist a user when operating the lever 13.

A locking mechanism 136 is positioned at an approximate midpoint of the lever bridging portion 132, between the pair of lever gripping portions 135. The locking mechanism 136 is complementary to the locking projection 126 positioned on the connector body 12, and engages thereto to lock the lever 13, preventing the lever 13 from rotating when the connectors 12,20 are completely mated.

Figure 4:
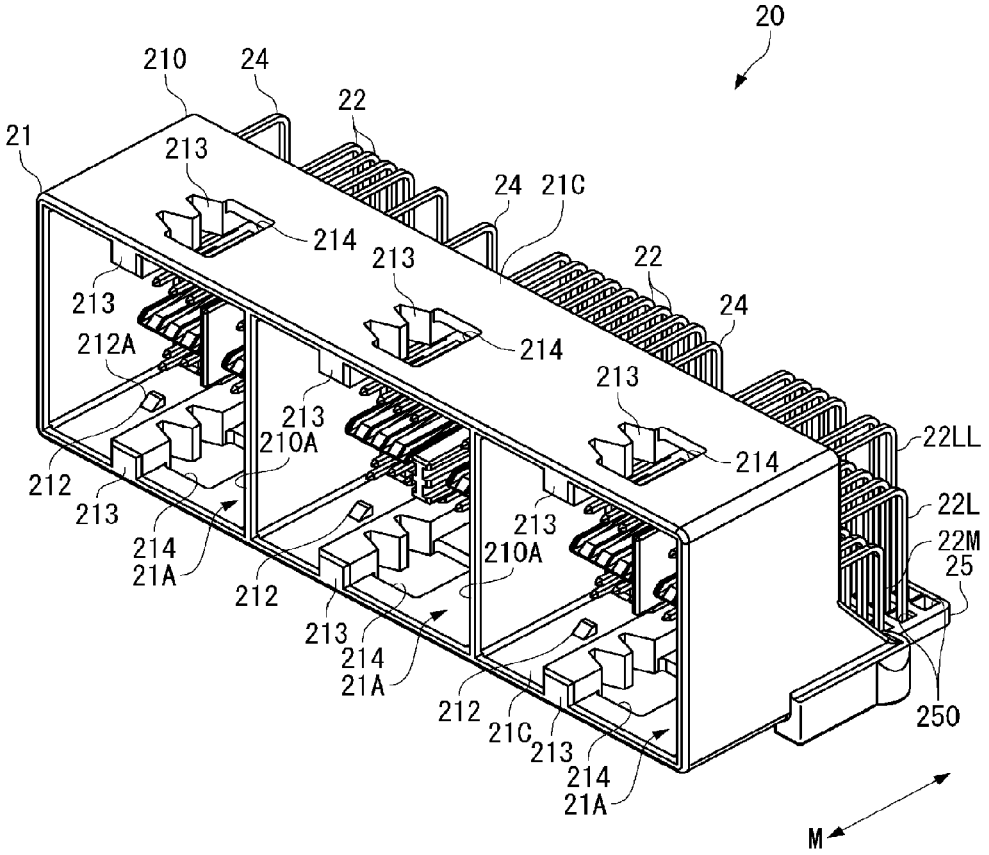
FIG. 4 is a perspective view of a cap connector.
Figure 6:
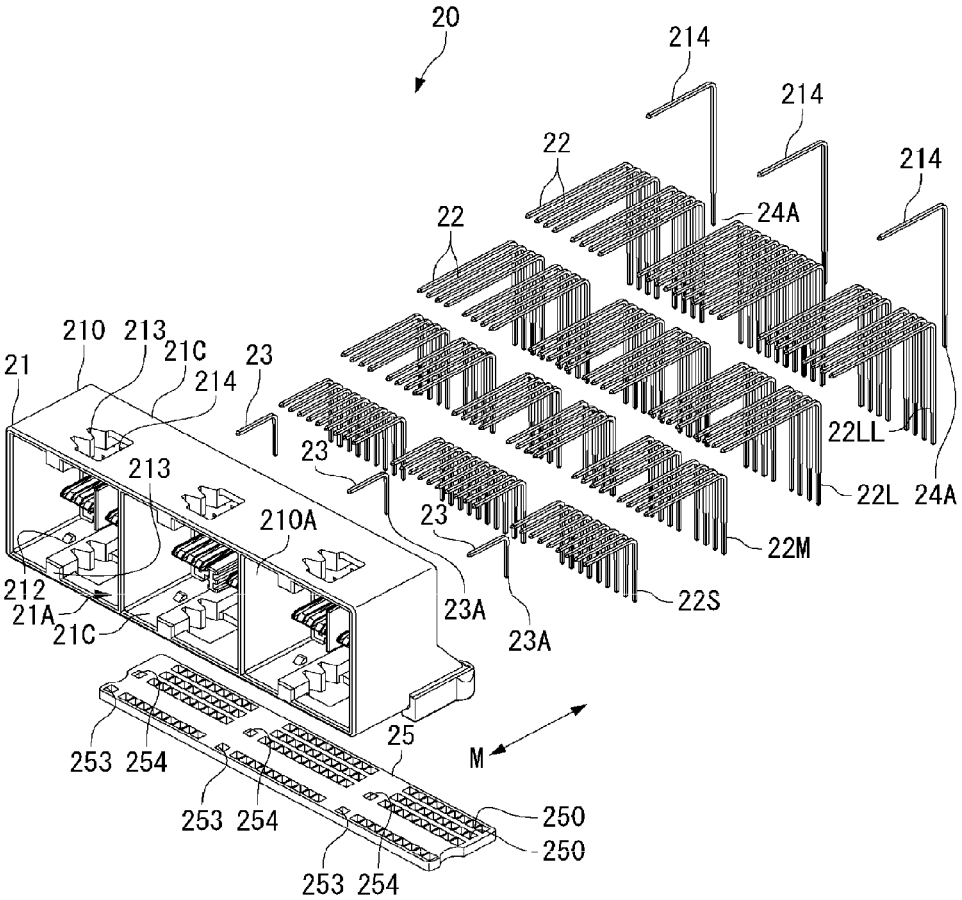
FIG. 6 is an exploded perspective view of the cap connector in FIG. 4.

The cap connector 20 has the cap connector housing 21, which includes plug connector receiving spaces 21A that receive the plug connectors 10, the plurality of male contacts 22 retained in the connector housing 21, the mating detection terminals 23, 24 similarly retained by the connector housings 21, and a contact alignment plate 25 that aligns the male contacts 22, as illustrated in FIGS. 4 and 6. The plug connector receiving spaces 21A are positioned on a mating end of the cap connector 20.

The cap connector housing 21 includes an approximately rectangular body 210 forming a common plug connector receiving space (not labeled), and partitioning walls 210A positioned in the plug connector receiving space of the body 210 integrally by injection molding. The body 210 includes two opposite sidewalls 12C, between which each partitioning wall 210A extends perpendicular to and connects together. In an embodiment, the common plug connector receiving space of the body 210 is partitioned by two partitioning walls 210A so that three plug connector receiving spaces 21A are formed, through which plug connectors 10 are respectively mated. In other embodiments, the plug connector receiving space of the body 210 is partitioned by zero, three, four, or more partitioning walls 210A.

Figure 5:
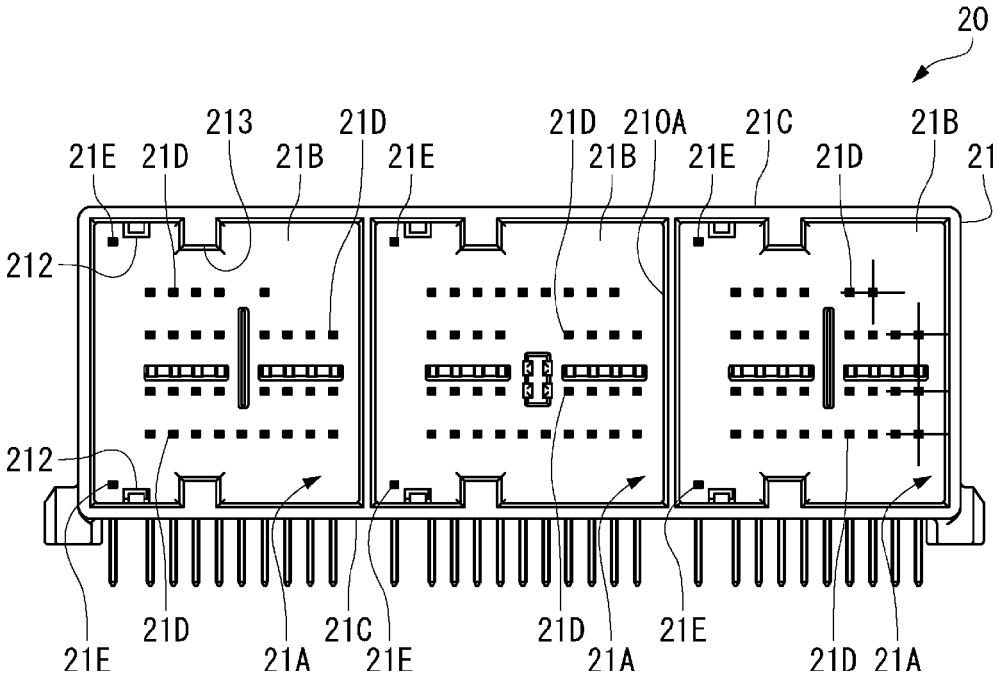
FIG. 5 (*a*) is an elevation view of the cap connector illustrated in FIG. 4.
Figure 5:
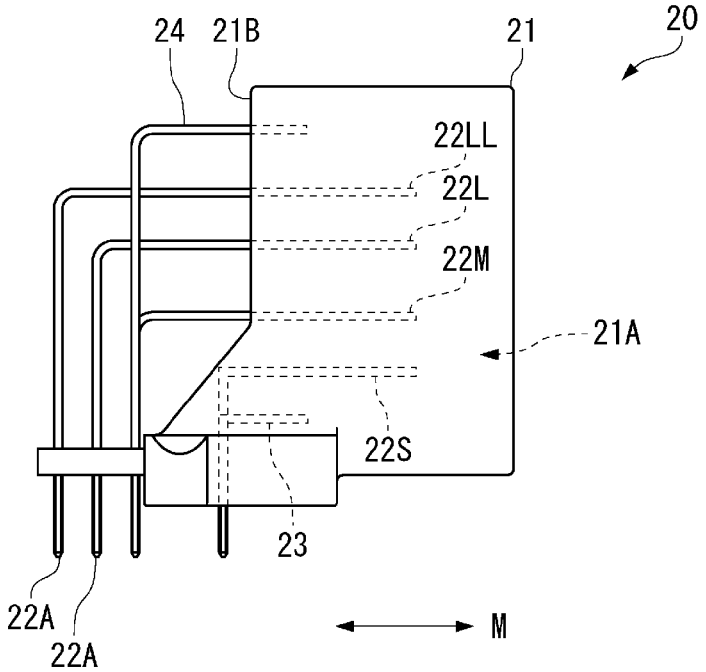

A contact receiving wall 21B (FIG. 5 (*a*)) is positioned in an innermost part of the plug connector receiving space 21A, along a terminating end of the cap connector 20, which is opposite the mating end. A plurality of contact retaining holes 21D are disposed in the contact receiving wall 21B, and penetrate therethrough in a thickness direction. In an embodiment, the contact receiving holes 21D are positioned in four rows. The male contacts 22 are retained in the cap connector housing 21 by being inserted into the contact receiving holes 21D.

Terminal receiving holes 21E are formed in the contact receiving wall 21B, and receive and secure the mating detection terminals 23, 24 when the connectors 10,20 are mated together.

Two of the retailing holes 21E are formed in the contact receiving wall 21B in each of the plug connector receiving spaces 21A, and extend through the contact receiving wall 21B in the thickness direction. Each of the terminal receiving holes 21E is positioned at an approximate corner of the contract receiving wall 21B in each of the plug connector receiving space 21A.

At least two clip engaging projections 212 are positioned in each plug connector receiving space 21A, one on an inner surface of each sidewall 12C, opposite to each other. Each clip engaging projection 212 has an inclined surface 212A (FIG. 8 (*b*)) inclined toward the inner surface of the sidewall 21C formed therein. The clip engaging projections 212 are complementary to the projections 145 on the locking arms 144 of the clip 14, and engage the projections 145 when the clip 14 is inserted into the mated connectors 10,20.

At least two cap connector gears 213 are positioned in each plug connector receiving space 21A, one on an inner surface of each sidewall 12C, opposite to each other and each adjacent to at least one clip engaging projection 212. The cap connector gear 213 projects from the inner surface of the sidewall 21C by a size equal to the thickness of the plug connector gear 134 of the lever 13. The cap connector gears 213 engage and mesh with the plug connector gears 134 in the lever 13 when the connectors 10,20 are mated with each other and when the mating is released.

A through hole 214, which penetrates through the sidewall 21C, is formed in a part adjacent to the cap connector gear 213.

In an embodiment, the male contacts 22 are positioned in the four rows, and inserted in the contact receiving holes 21D (FIG. 5 (*a*)) in the cap connector housing 21.

In an embodiment, the male contacts 22 extend a distance out of the contact receiving holes 21D along a mating direction, then bend orthogonally to the mating direction. The male contacts 22 then extend through alignment holes 250 in a contact alignment plate 25. A terminating end 22A (FIG. 5 (*b*)) of the male contact 22 projects from the contact alignment plate 25 and is connected to a circuit board (not illustrated). In an embodiment, the male contacts 22 have an approximate L-shape.

Four types of the male contacts 22 of different sizes are provided, as illustrated in FIG. 6, depending on distances between the contact receiving holes 21D in each of the four rows into which the male contacts 22 are positioned, and the circuit board.

More specifically, the male contacts 22 include four types of contacts, i.e., a first contact 22S arranged in a first row, a second contact 22M arranged in a second row, a third contact 22L arranged in a third row, and a fourth contact 22LL arranged in a fourth row. The four types of contacts 22S,M,L,LL are respectively formed in substantially similar L shapes. The first contact, the second contact, the third contact, and the fourth contact increase in size in this order.

The mating detection terminals 23, 24 are formed of an electrically conductive material such as a metal or carbon.

The mating detection terminal 23 is shorter in height than the first contact 22S, and has an approximate L-shape. The mating detection terminal 23 is positioned in a terminal receiving hole 21E proximate to the circuit board, extending through the terminal receiving holes 21E formed in the contact receiving wall 21B (FIG. 5 (*a*)).

The mating detection terminal 24 is longer in height than the fourth contact 22LL, and has an approximate L-shape. The mating detection terminal 24 is positioned in a receiving hole 21E distal to the circuit board.

The mating detection terminals 23, 24 project into the plug connector receiving space 21A by an equal length from the inner surface of the contact receiving wall 21B (FIG. 5 (*b*)).

Terminating ends 23A, 24A of the mating detection terminals 23, 24 are respectively inserted into alignment holes 243, 254 (FIG. 6) formed in the contact alignment plate 25 and extend outward therefrom. The terminating ends 23A, 24A of the mating detection terminals 23, 24 are connected to the circuit board (not illustrated).

In an embodiment the mating detection terminal 142 of the clip 14 and the mating detection terminals 23, 24 provided in the cap connector 20 electrically detect that the connectors 10,20 are completely mated together.

Detection of a completed mating action by the mating detection terminals 142, 23, 24 will be described below while describing a procedure for mating the plug connector 10 and the cap connector 20 by the operation of the lever 13.

Figure 7:
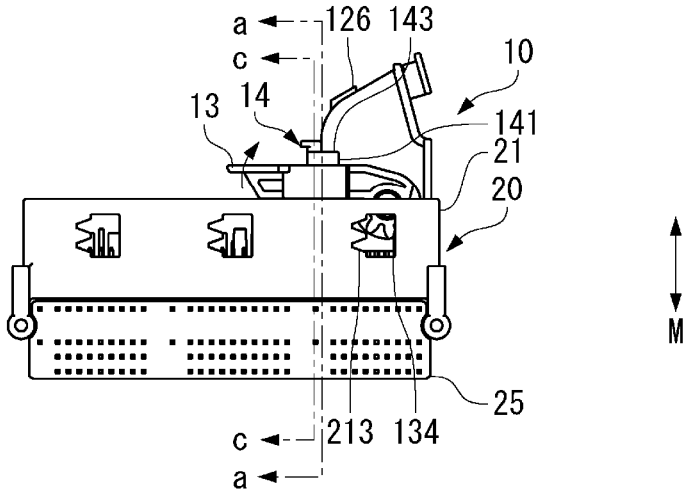
FIG. 7 (*a*) is a diagram of a procedure for mating the plug connector with the cap connector.
Figure 7:
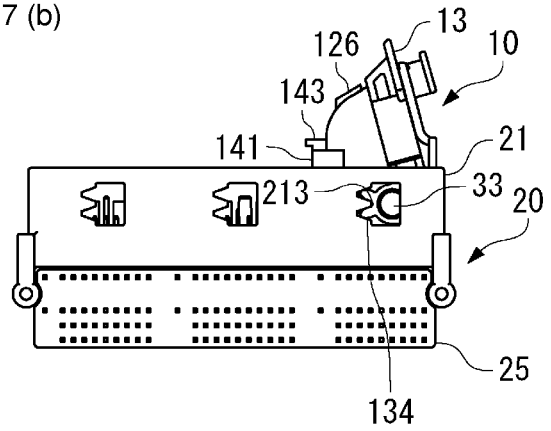
Figure 7:
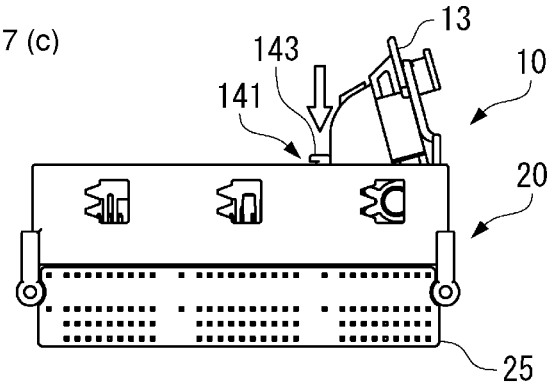

In an embodiment of FIG. 7 (*a*), the plug connector 10 is partially mated with the cap connector housing 21 of the cap connector 20. The lever 13 is positioned substantially perpendicular to the mating direction M and is at the position where the mating operation is started. The plug connector gear 134 of the lever 13 is positioned at an end of the cap connector gear 213 in the cap connector housing 21 of the cap connector 20. In this partially mated position, the body 141 of the clip 14 is not pressed in, and the bridging portion 143 projects upward, away from the lever 13.

When the lever 13 is rotated in a direction indicted by an arrow in FIG. 7(*a*), and is brought into a raised state substantially along the mating direction M, as illustrated in FIG. 7 (*b*), the plug connector gear 134 of the lever 13 meshes with the cap connector gear 213 of the cap connector housing 21, and the cap connector housing 21 is drawn as the lever 13 is rotated. As a result, through the rotational action of the lever 13, the plug connector 10 is pulled into the plug connector receiving space 21A and mating with the cap connector housing 21 is completed.

The locking mechanism 136 (FIG. 3) of the lever 13 rides over the locking projection 126 of the connector body 12, and the locking projection 126 engages the locking mechanism 136 to lock the lever 13 in position.

At this time, the plug connector 10 and the cap connector 20 are completely mated together.

Once the connectors 10,20 are completely mated together, the bridging portion 143 of the clip 14 is permitted to be pressed in, as illustrated in FIG. 7 (*c*). If the connectors 10,20 are not completely mated together, the user will not be able to press the bridging portion 143 in.

The act of a user being able to press the clip 14 in serves as confirmation to the user that the connectors 10, 20 are completely mated together.

The operation of the clip 14 will be described while following the procedure illustrated in FIGS. 7 (*a*) to 7 (*c*).

In an embodiment of FIGS. 8(*a*)-8(*c*), an exemplary mating procedure between the mating detection terminal 142 and the mating detection terminals 23, 24 is disclosed.

When the plug connector 10 and the cap connector 20 are partially mated together in the disengaged position, as illustrated in FIG. 7 (*a*), the projection 145 of the locking arm 144 is positioned in the projection receiving hole 154 of the clip receiving member 15, such that the body 141 is locked to the clip receiving member 15, as illustrated in FIGS. 8 (*a*) and 8 (*b*). Thus, the body 141 cannot be pressed in when the connectors 10,20 are partially mated together.

Additionally, the mating detection terminal 142 in the body 141 is spaced apart from the mating detection terminals 23, 24 in the cap connector housing 21, as illustrated in FIG. 8 (*c*). Thus, when the connectors 10,20 are partially mated together, the mating detection terminal 142 and the mating detection terminals 23, 24 are not electrically connected together.

Figure 9:
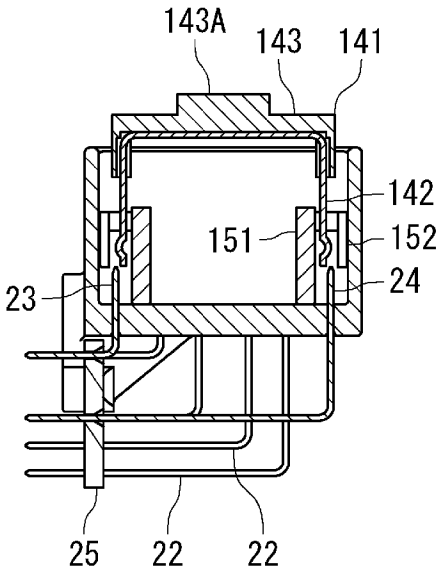
FIG. 9 (*a*) is a cross-sectional views similar to FIG. 8 (*a*)
Figure 9:
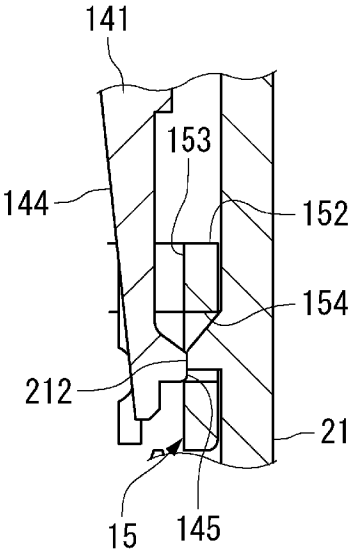
Figure 9:
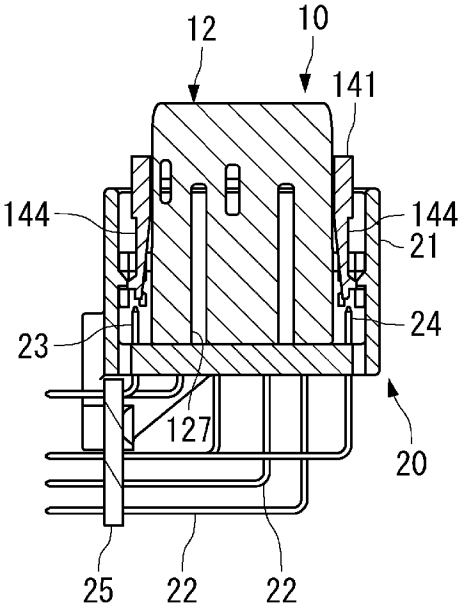

When the connectors 10,20 are completely mated together, as illustrated in FIG. 7 (*b*), through rotation of the lever 13, the clip engaging projection 212 of the cap connector housing 21 enters the projection receiving hole 154 in the clip receiving member 15, as illustrated in FIGS. 9 (*a*) and 9 (*b*). The clip engaging projection 212 presses against the projection 145 of the locking arm 144, such that the projection 145 separates from the projection receiving hole 154. Thus, the body 141 is released from the clip receiving member 15, so that the body 141 can be pressed into the clip receiving member 15. At this time, the locking arm 144 is slightly deflected when the projection 145 is pressed by the clip engaging projection 212.

However, the mating detection terminals 142 and 23, 24 are still not electrically connected to each other, although the mating detection terminal 142 approaches the mating detection terminals 23, 24, as illustrated in FIG. 9 (*c*), when the plug connector 10 is pressed into the cap connector housing 21.

Figure 10:
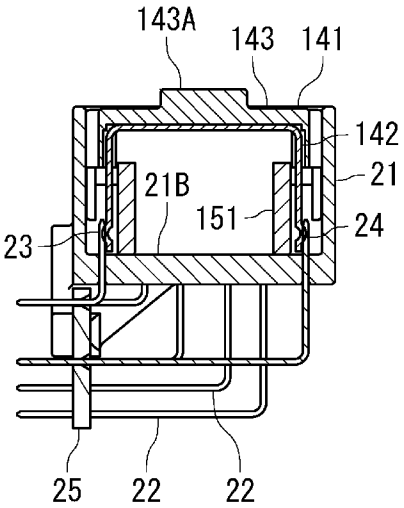
FIG. 10 (*a*) is a cross-sectional view of FIG. 8 (*a*)
Figure 10:
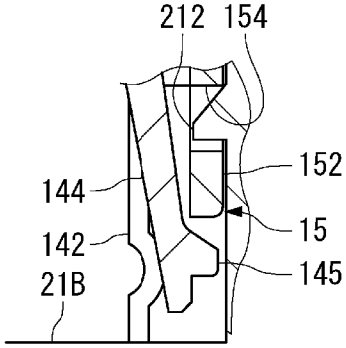
Figure 10:
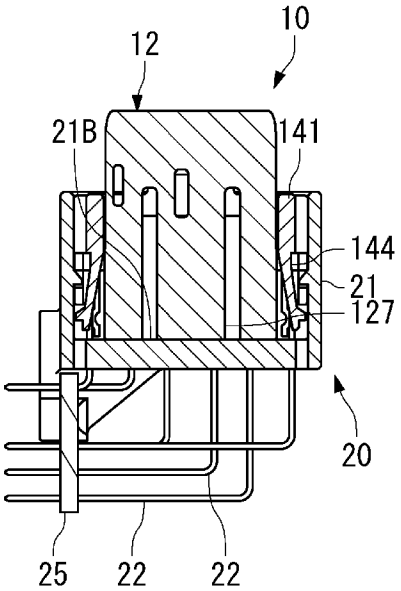

When the bridging portion 143 of the body 141 is then pressed in, as illustrated in FIG. 7 (*c*), the locking arm 144 moves toward the contact receiving wall 21B of the cap connector housing 21, as illustrated in FIG. 10 (*a*). At this time, the projection 145 of the locking arm 144 rides over the cantilever beam 152 of the clip receiving member 15, and is sandwiched between the leading end of the cantilever beam 152 and the contact receiving wall 21B by the locking arm 144. Thus, the movement of the body 141 is restricted.

A distance between the mating detection terminal 142 and the mating detection terminals 23, 24 is reduced as the body 141 is pressed in, and the mating detection terminal 142 is brought into contact with and electrically connected to the mating detection terminals 23, 24, as illustrated in FIG. 10 (*c*), when the projection 145 of the locking arm 144 rides over the cantilever beam 152 (FIG. 10 (*b*)).

This contact forms a conduction path that includes the mating detection terminal 142, the mating detection terminal 23 and the mating detection terminal 24.

In an embodiment, inspection for detecting energization of the conduction path may be performed. When the conduction path is energized, the user can confirm that the body 141 is pressed in. Pressing the body 141 means that the connectors 10, are completely mated together.

If the conduction path is not energized, the mating detection terminal 142 and the mating detection terminals 23, 24 are not electrically connected to each other, because the body 141 has not been installed or has not been pressed in.

In an embodiment, an electric/electronic element is provided on the circuit board, which detects the energization of the conduction path including the mating detection terminal 142, the mating detection terminal 23 and the mating detection terminal 24.

The electric/electronic element and appropriate hardware may provide notification of an incomplete mating of the connectors 10,20 by issuing a warning sound or a warning message if the conduction path is not energized.

The mating detection terminal 142 and the mating detection terminals 23, 24 can compensate for user failure in mating connectors 10,20 by electrically detecting that the mating status of the connectors 10,20. Thus, the connector position assurance can be implemented at a higher level.

Referring to FIGS. 11 to 14, a second embodiment of the present invention will be described below.

In an embodiment of FIGS. 11-14, a position of a mating detection terminal differs from that in the above described embodiments of FIGS. 1-10. While differences from the above embodiments will be described, similar elements to the elements described in the above embodiment are assigned the same reference numerals. For example, each of a lever type plug connector 30 (FIG. 11) and a cap connector 40 (FIG. 13) to be mated with the plug connector 30 will be described.

Figure 11:
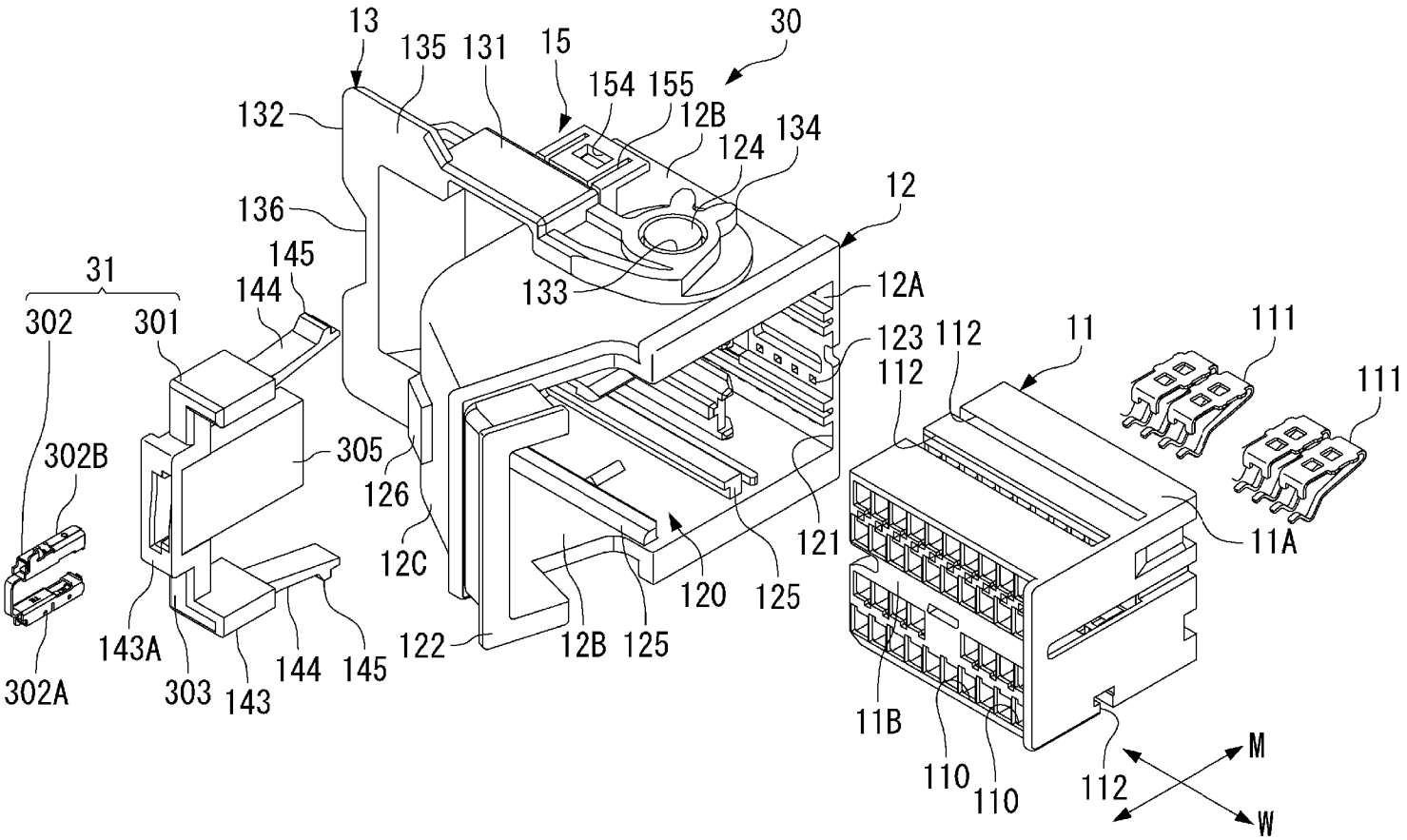
FIG. 11 is an exploded perspective view of a plug connector.

In an embodiment of FIG. 11, the plug connector 30 includes a contact housing 11, a connector body 12 positioned over the contact housing 11, a lever 13 disposed on the connector body 12, and a clip 31.

The clip 31 includes a body 301 and a mating detection terminal 302.

The body 301 has a bridging portion 303 and a pair of locking arms 144.

A detection terminal receiving member 305, which receives the mating detection terminal 302 in a mating detection terminal receiving space (not labeled), is integrally formed in the bridging portion 303.

Figure 12:
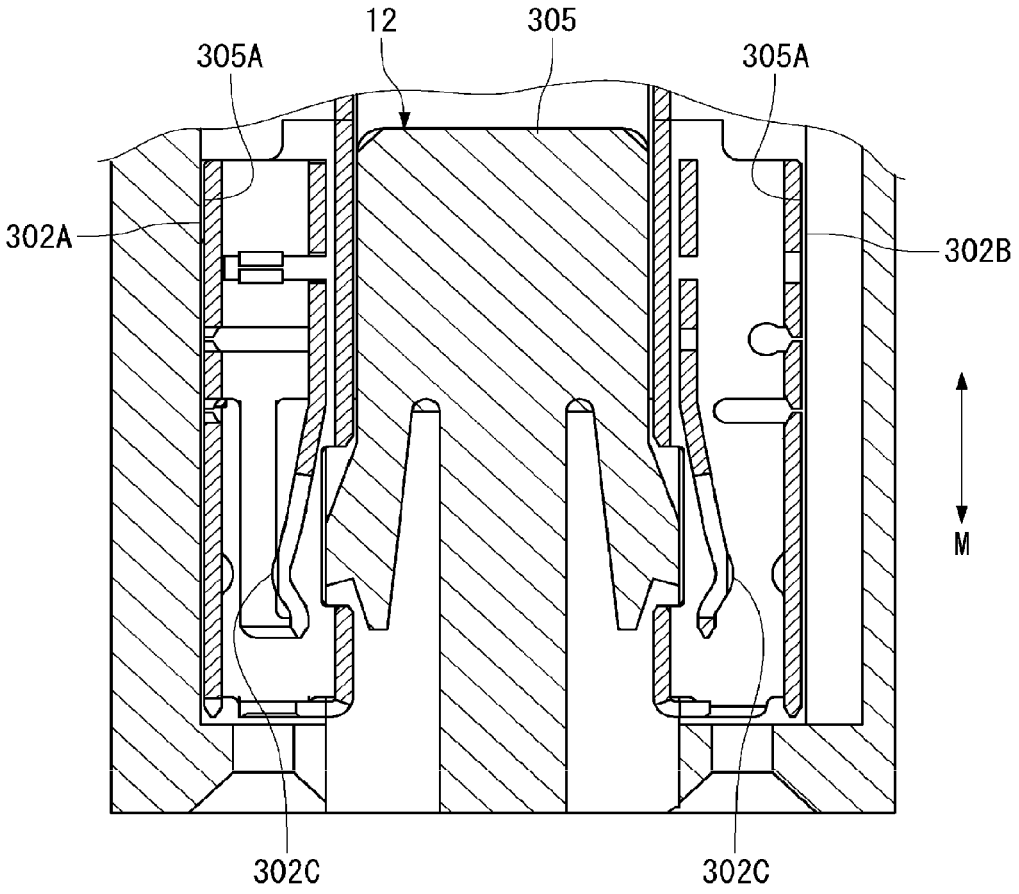
FIG. 12 is a cross-sectional view of a connector position assurance mechanism.

The detection terminal receiving member 305 includes a pair of terminal arm receiving cavities 305A extending along a mating direction M, as illustrated in FIG. 12.

The mating detection terminal 302 has a pair of cylindrical terminal arms 302A, 302B. The terminal arms 302A, 302B are connected together on an end through a terminal bridging portion (not labeled).

Each of the terminal arms 302A, 302B is formed by bending a metal plate in a cylindrical shape, and has a contact 302C formed along an inward facing surface of the cylindrical wall, as illustrated in FIG. 12.

The terminal arms 302A, 302B are inserted into the terminal arm receiving cavity 305A so that the mating detection terminal 302 is retained by the body 301.

Figure 13:
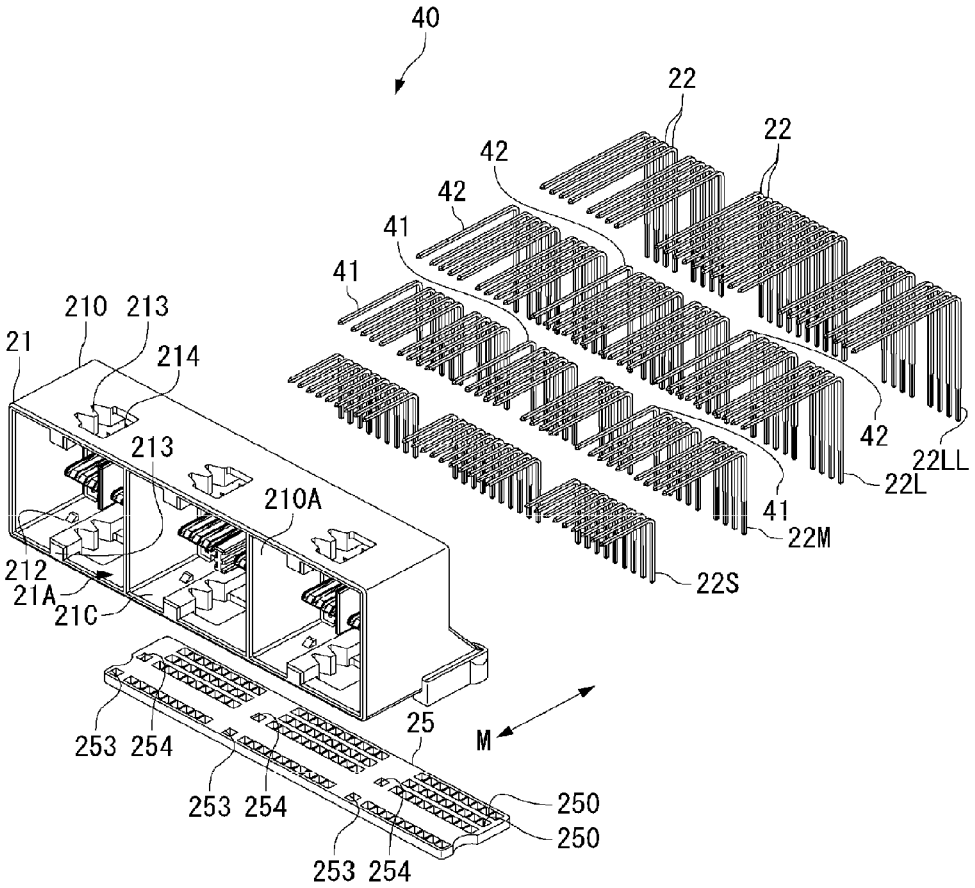
FIG. 13 is an exploded perspective view of a cap connector.
Figure 14:
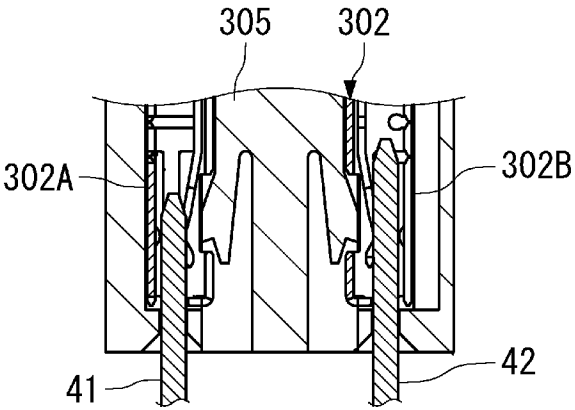
FIG. 14 (*a*) is a cross-sectional view of the plug connector and the cap connector.
Figure 14:
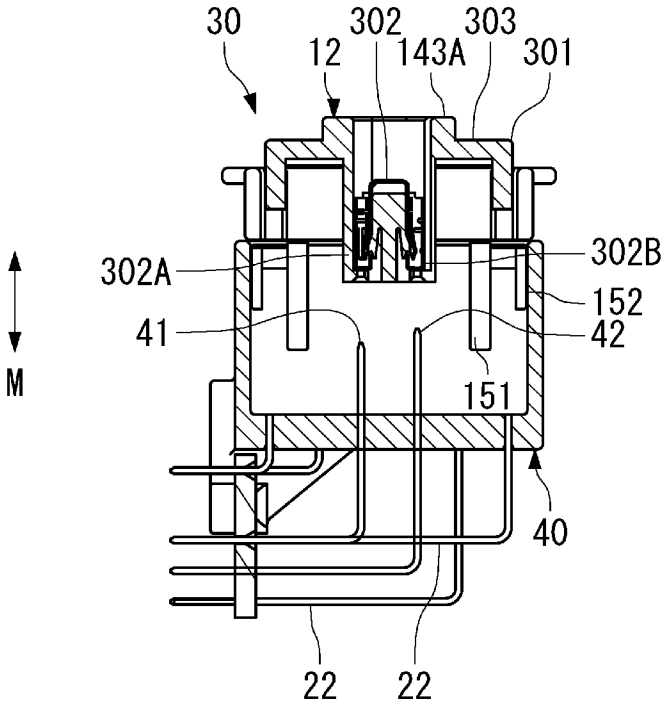

As illustrated in FIG. 13, the cap connector 40 includes a cap connector housing 21, a plurality of male contacts 22 retained by the cap connector housing 21, mating detection terminals 41, 42 retained by the cap connector housing 21, and a contact alignment plate 25 that aligns the terminating ends of the male contacts 22.

The mating detection terminal 41 is the same in shape and size as the second contacts 22M positioned in the second row.

The mating detection terminals 41, together with the second contacts 22M, are positioned in the second row. A detection terminal receiving hole (not shown), which retains the mating detection terminal 41, is positioned adjacent to the contact receiving hole 211), which retains the second contact 22M to the contact receiving wall 21B (FIG. 5 (*a*)) of the cap connector housing 21.

The mating detection terminal 42 is the same in shape and size as a third contact 22L positioned in the third row.

The mating detection terminals 42, together with the third contacts 22L, are positioned in the third row. A detection terminal receiving hole (not shown), which retains the mating detection terminal 42, is added adjacent to the contact receiving hole 21D, which retains the third contact 22L, to the contact receiving wall 21B (FIG. 5 (*a*)) of the cap connector housing 21.

The same member as the second contact 22M can be used for the mating detection terminal 41. The same member as the third contact 22L can be used for the mating detection terminal 42. Thus, the number of types of members can be reduced, contributing to reduction of cost.

In an embodiment, the plug connector 30 and the cap connector 40 are mated with each other by an operation of the lever 13, and the completion of the mating is confirmed by pressing the body 301, as described in the above embodiments. Also similar to the above embodiments, the locking arm 144 of the body 301 performs the same engagement mechanism with the plug connector 30.

In an embodiment, when the connectors 30 and 40 are only partially mated together, the terminal arms 302A, 302B of the mating detection terminal 302 and the mating detection terminals 41, 42 in the cap connector 40 are spaced apart in the mating direction M.

As the lever 13 is rotated to complete the mating of the connectors 30,40 together, the bridging portion 303 of the body 301 is allowed to be pressed in by a user. Consequently, the mating detection terminal 41 contacts the terminal arm 302A in the mating detection terminal 302, and the mating detection terminals 41 and 42 are brought into electrical connection to each other.

Thus, the complete mating of the connectors 30, 40 can be determined by detecting whether a conduction path is formed between the mating detection terminal 302, the mating detection terminals 41, 42 and a circuit board.

Accordingly, while different embodiments of the body in the clip and the mating detection terminal have been described, the end function is the same.

Generally, the body in the clip has electrical conductivity by using an electrically conductive material such as a metal or carbon as a material for the body. The mating detection terminal to be electrically connected to the body is provided in a housing of the mating connector.

Figure 15:
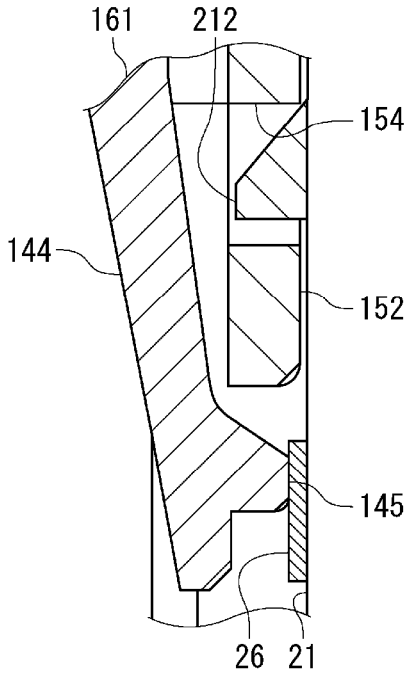
FIG. 15 (*a*) is a view of an electrical connector assembly having a connector position assurance device; and, FIG. 15 (*b*) is a schematic view of an electrical connector assembly having a connector position assurance device.
Figure 15:
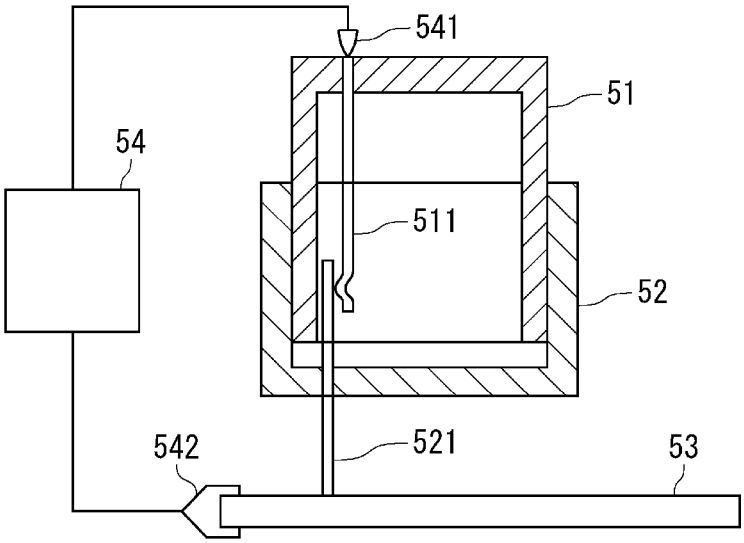

When connectors are completely mated together, for example, a mating detection terminal 26, which is brought into contact with and electrically connected to a projection 145 of an locking arm 144 in a body 161 having electrical conductivity, may be provided in a cap connector housing 21, assuming that the projection 145 is at a position riding over a cantilever beam 152, as illustrated in FIG. 15 (*a*).

In addition to the above described embodiments, one of ordinary skill in the art would appreciate that various changes and substitutions can be made as needed, without departing from the scope of the present invention.

While each of the cap connectors 20, 40 in each of the above-described embodiments includes the two mating detection terminals, a single mating detection terminal 521 may be provided, such as a second connector 52 illustrated in FIG. 15 (*b*). The mating detection terminal 521 is connected to a circuit board 53.

A first connector 51, which is mated with the second connector 52, includes a clip (not illustrated). The clip includes a mating detection terminal 511 that is brought into contact with and electrically connected to the mating detection terminal 521 in the second connector 52. The mating status of the connectors 51,52 can therefore be electrically detected using the mating detection terminal 511 and the mating detection terminal 521.

In an embodiment, a probe 541 is provided in a mating detection device 54 that is connected to the mating detection terminal 511, while a second probe 542 is connected to the mating detection terminal 521, to form a conduction path (electric circuit) among the mating detection terminal 511, the mating detection terminal 521 and a mating detection device 54. The mating detection device 54 detects energization of the electric circuit, to compensate for failure and deficiency in work for operating the clip. Thus, assurance of a mating position between the first connector 51 and the second connector 52 can be implemented at a higher level.

While in each of the above-described embodiments, the lever type connectors (plug connectors 10, 30) have been shown as an example of a connector in the present invention having a CPA mechanism, the present invention is applicable to various connectors regardless of the type of connector, i.e., a lever type or a slide type.

A clip in the present invention is not limited to the configuration illustrated in each of the above-mentioned embodiments, and can widely adopt a configuration of a known clip.

What is claimed is:

1. An electrical connector comprising:

a connector position assurance mechanism; and a clip having:

a body received in the connector position assurance mechanism only when the electrical connector is completely mated with a complimentary mating connector, and a mating detection terminal that contacts a complementary mating detection terminal in the mating connector to form an electrical circuit only when the body is positioned in the electrical connector.

2. The electrical connector of claim 1, wherein the body has a terminal receiving groove.

3. The electrical connector of claim 2, wherein the mating detection terminal is positioned in the terminal receiving groove.

4. The electrical connector of claim 3, wherein the body further comprises a bridging portion bent forward at opposite ends to form an approximate U-shape.

5. The electrical connector of claim 4, wherein the body further comprises a pair of locking arms positioned on each opposite end.

6. The electrical connector of claim 5, wherein the connector position assurance mechanism includes:

a lever hingedly connected to a connector body of the electrical connector, and having a clip receiving groove; and a clip receiving member positioned on the connector body.

7. The electrical connector of claim 6, wherein the lever has a mating position when the electrical connector is mated with the mating connector and a disengaged positioned when the electrical connector is disengaged from the mating connector.

8. The electrical connector of claim 7, wherein the body of the clip is received in the clip receiving groove when the lever is in the mating position.

9. The electrical connector of claim 8, wherein the pair of locking arms are received in the clip receiving member when the lever is in the mating position.

10. The electrical connector of claim 9, wherein the inserted clip locks the lever in the mating position.

11. The electrical connector of claim 1, wherein the mating detection terminal is approximately U-shaped.

12. The electrical connector of claim 1, wherein the body is also the mating detection terminal.

13. The electrical connector of claim 1, wherein the body has a bridging portion bent forward at opposite ends to form an approximate U-shape.

14. The electrical connector of claim 13, wherein the body further comprises a detection terminal receiving member integrally formed in the bridging portion.

15. The electrical connector of claim 14, wherein the detection terminal receiving member has a pair of terminal arm receiving cavities extending along a mating direction.

16. The electrical connector of claim 15, wherein the mating detection terminal has a pair of cylindrical terminal arms connected together on an end, through a terminal bridging portion, to form an approximate U-shape.

17. The electrical connector of claim 16, wherein the pair of terminal arms are positioned in the terminal arm receiving cavities.

18. An electrical connector assembly comprising:

a first connector having a first mating detection terminal; and a complementary second connector having a connector position assurance mechanism, and a clip having a body received in the connector position assurance mechanism only when the second electrical connector is completely mated with the first mating connector, and a complementary second mating detection terminal that contacts the first mating detection terminal to form an electrical circuit only when the body is received in the connector position assurance mechanism.

19. The electrical connector assembly of claim 18, wherein the first connector includes the two mating detection terminals connected to a circuit board, and the second connector includes two second mating detection terminals.

20. The electrical connector assembly of claim 19, wherein the two first mating detection terminals are electrically connected to the two second mating detection terminals when the first connector is completely mated with the second connector.

* * * * *